US007540228B1

(12) United States Patent
Cronin et al.

(10) Patent No.: US 7,540,228 B1
(45) Date of Patent: Jun. 2, 2009

(54) CERAMIC ARMOUR AND METHOD OF CONSTRUCTION

(75) Inventors: Duane S. Cronin, Waterloo (CA); Michael James Worswick, Waterloo (CA); Christopher Peter Salisbury, Waterloo (CA); Christian Kaufmann, Waterloo (CA)

(73) Assignee: Strike Face Technology Incorporated, Waterloo, ON (CA)

( * ) Notice: Subject to any disclaimer, the term of this patent is extended or adjusted under 35 U.S.C. 154(b) by 577 days.

(21) Appl. No.: 10/960,284

(22) Filed: Oct. 8, 2004

Related U.S. Application Data

(60) Provisional application No. 60/514,621, filed on Oct. 28, 2003.

(51) Int. Cl.
*F41H 5/02* (2006.01)

(52) U.S. Cl. ..... 89/36.02; 89/36.05; 89/36.07; 2/2.5

(58) Field of Classification Search ..... 89/36.02, 89/36.05, 36.07; 2/2.5; 109/49.5; 428/49
See application file for complete search history.

(56) References Cited

U.S. PATENT DOCUMENTS 5,191,166 A * 3/1993 Smirlock et al. ..... 89/36.02
5,349,893 A 9/1994 Dunn
5,534,343 A 7/1996 Landi et al.
5,996,115 A * 12/1999 Mazelsky ..... 2/2.5
6,253,655 B1 * 7/2001 Lyons et al. ..... 89/36.02
6,408,733 B1 * 6/2002 Perciballi ..... 89/36.02
7,150,217 B2 * 12/2006 Kershaw ..... 89/36.05
7,210,390 B1 * 5/2007 Olson et al. ..... 89/36.05
2004/0118271 A1 6/2004 Puckett et al.
2005/0066805 A1 * 3/2005 Park et al. ..... 89/36.02
2006/0065111 A1 * 3/2006 Henry ..... 89/36.02

FOREIGN PATENT DOCUMENTS

WO 02/055952 7/2002
WO 03/010484 2/2003

* cited by examiner

*Primary Examiner*—J. Woodrow Eldred
(74) *Attorney, Agent, or Firm*—Hill & Schumacher; Lynn C. Schumacher

(57) ABSTRACT

An armor for protection against large caliber projectiles has a ceramic layer with a confinement layer on a front thereof. The ceramic layer is backed by a first metallic layer and the first metallic layer in turn is backed by a composite layer. The composite layer is backed by a second metallic layer, which in turn is backed by an anti-trauma layer. The armor is used to protect personnel, but it can also be used to protect objectives such as vehicles.

27 Claims, 3 Drawing Sheets

Figure 2
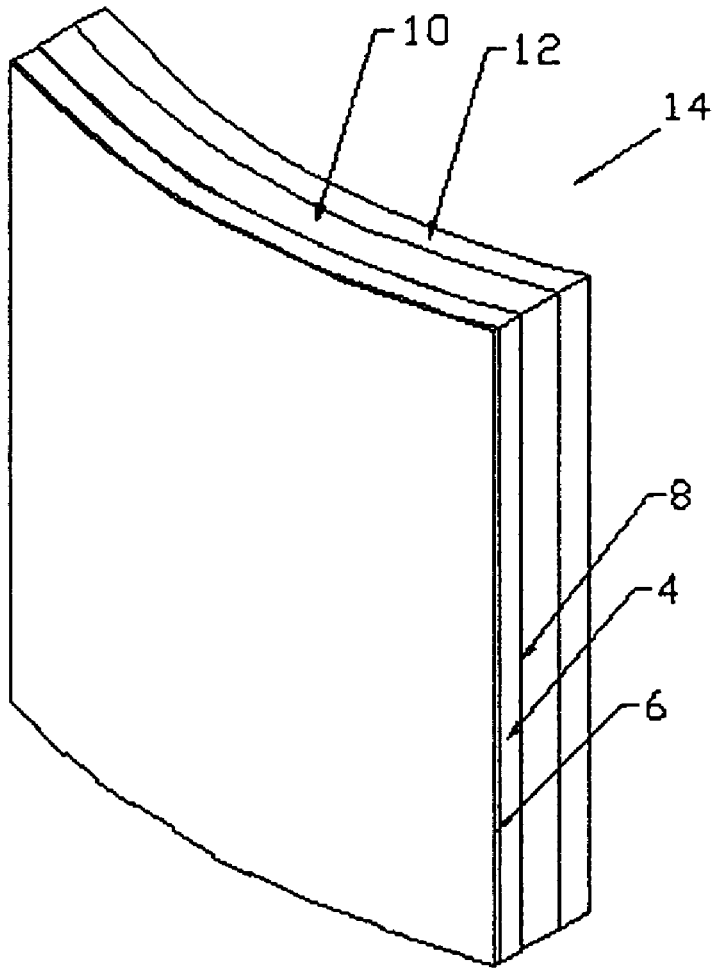
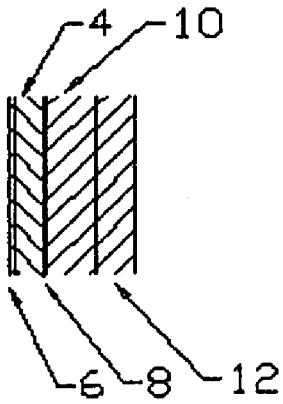
Figure 3

CERAMIC ARMOUR AND METHOD OF CONSTRUCTION

CROSS REFERENCE TO RELATED APPLICATION

This patent application relates to, and claims the priority benefit from, U.S. Provisional Patent Application Ser. No. 60/514,621 filed on Oct. 28, 2003 entitled CERAMIC ARMOUR AND METHOD OF CONSTRUCTION and which is incorporated herein in its entirety.

FIELD OF INVENTION

This invention relates to an armor for protection against large caliber projectiles where the armor has a ceramic layer and a metallic layer.

BACKGROUND OF THE INVENTION

Ceramic armors are known. However, previous armors are much too heavy or too bulky or too expensive or they do not provide sufficient protection or any protection against large caliber projectiles. Traditional soft armor used in many types of protective vests are typically made of layers of flexible fabric or non-woven textile using fibers such as aramid (such as Kevlar® or Twaron®) or polyethylene (such as Spectra Shield® or Dyneema®) or other types of fibers. When a bullet strikes these layered armors, the impact produces a bulge which deforms the back surface of the armor. Since the armor is worn adjacent to the body, this bulge, or deformation, projects into the body of the wearer which can cause tissue damage or trauma to the underlaying body part.

U.S. Pat. No. 5,534,343 teaches the use of an inner layer of flexible cellular material in a flexible armor.

U.S. Pat. No. 5,349,893 discloses a ceramic armor having an inner layer of rigid, semi-flexible or semi-rigid cellular material.

U.S. Pat. No. 5,847,308 issued to Singh et al. teaches a passive roof armor system which includes a stack of ceramic tiles and glass layers.

U.S. Pat. No. 6,203,908 issued to Cohen is directed to an armor having an outer steel layer, layers of high density ceramic bodies bonded together, and an inner layer of high-strength anti-ballistic fibres such as KEVLAR™.

U.S. Pat. No. 6,135,006 issued to Strasser et al. discloses a multi-layer composite armor which includes alternating hard and ductile layers formed of fiber-reinforced ceramic matrix composite.

Canadian Patent application Serial No. 2,404,739 to Lucuta et al. discloses a multi-layer ceramic armor with improved ceramic components to deflect a projectile on impact, bonded to a shock absorbing layer constructed of a polymer-fiber composite material, and further bonded to a backing of ballistic composite or metallic material. In the designs presented by Lucuta et al. all ceramic materials are backed by: polymer-fiber composite, additional ceramic components, or polymeric components while the current design uses a metallic layer directly bonded to the ceramic. The backing layer in traditional armour is made of a ballistic composite material. Lucuta et al. claim the use of a ballistic composite or metallic layer.

United States Patent Publication No. US2004/0118271A1 to Puckett et al. is directed to reducing the impact of armor deformation by reducing the peak load using a trauma reduction layer such as cellular honeycomb urethane materials. The current design proposes the use of a polymeric layer between the armor and wearer to further reduce the impact, and this process is generally known and used in the armor industry.

Therefore there is a need for an armor that overcomes that provides better protection to underlying tissue and organs of the person wearing the armor.

SUMMARY OF THE INVENTION

It is an object of the invention to provide an armor and a method of construction thereof that is lightweight and relatively thin, yet provides protection against large caliber projectiles. It is a further object of the present invention to provide an armor and method of construction where the armor can be used as body armor or as protection for vehicles or other objects with reduced deformation and trauma when impacted by large caliber projectiles.

In another aspect of the invention there is provided personal armor for protection against large caliber armor piercing projectiles comprising a ceramic layer with a first confinement layer on a front thereof, said ceramic layer being backed by a first nonporous solid metallic layer of high strength and ductility for distributing an impact load from a projectile and ceramic debris and for confining the debris in an impact zone within said ceramic layer, said first nonporous solid metallic layer being thinner than said ceramic layer, said first nonporous solid metallic layer being 1.11 mm or less in thickness and backed by a ballistic composite layer made of ballistic fabrics, fabric weaves and polymeric matrix materials for stopping a projectile and ceramic debris while minimizing deformation, with the various layers being bonded together by a suitable adhesive, said sequence of ceramic layer, nonporous solid metallic layer and ballistic composite layer exhibiting a back face deformation of 44 mm or less in clay as measured in accordance with a National Institute of Justice (NIJ) Standard when impacted on a front surface of said ceramic layer by projectile threats corresponding to NIJ Threat Levels up to 0.50 caliber, armor piercing, high energy projectiles.

In another embodiment of the armor the composite layer may be backed by an additional metallic layer to further reduce dynamic deformation.

Preferably, the first metallic layer is extremely thin relative to a thickness of the ceramic layer.

Still more preferably, the confinement layer is a fiber reinforced polymeric layer.

Preferably, the first metallic layer is made from titanium.

A method of constructing an armor for protection against large caliber projectiles, the method comprising affixing a first metallic layer to a back of a ceramic layer, affixing a confinement layer to a front of the ceramic layer, affixing a composite layer to a back of the first metallic layer, and using a suitable adhesive to affix the various layers together. A second metallic layer may be used to back the composite layer.

BRIEF DESCRIPTION OF THE DRAWINGS

FIG. 2 is a perspective view of a curved armor having five layers;

FIG. 3 is a schematic side view of an armor having five layers;

DETAILED DESCRIPTION OF THE INVENTION

Figure 1:
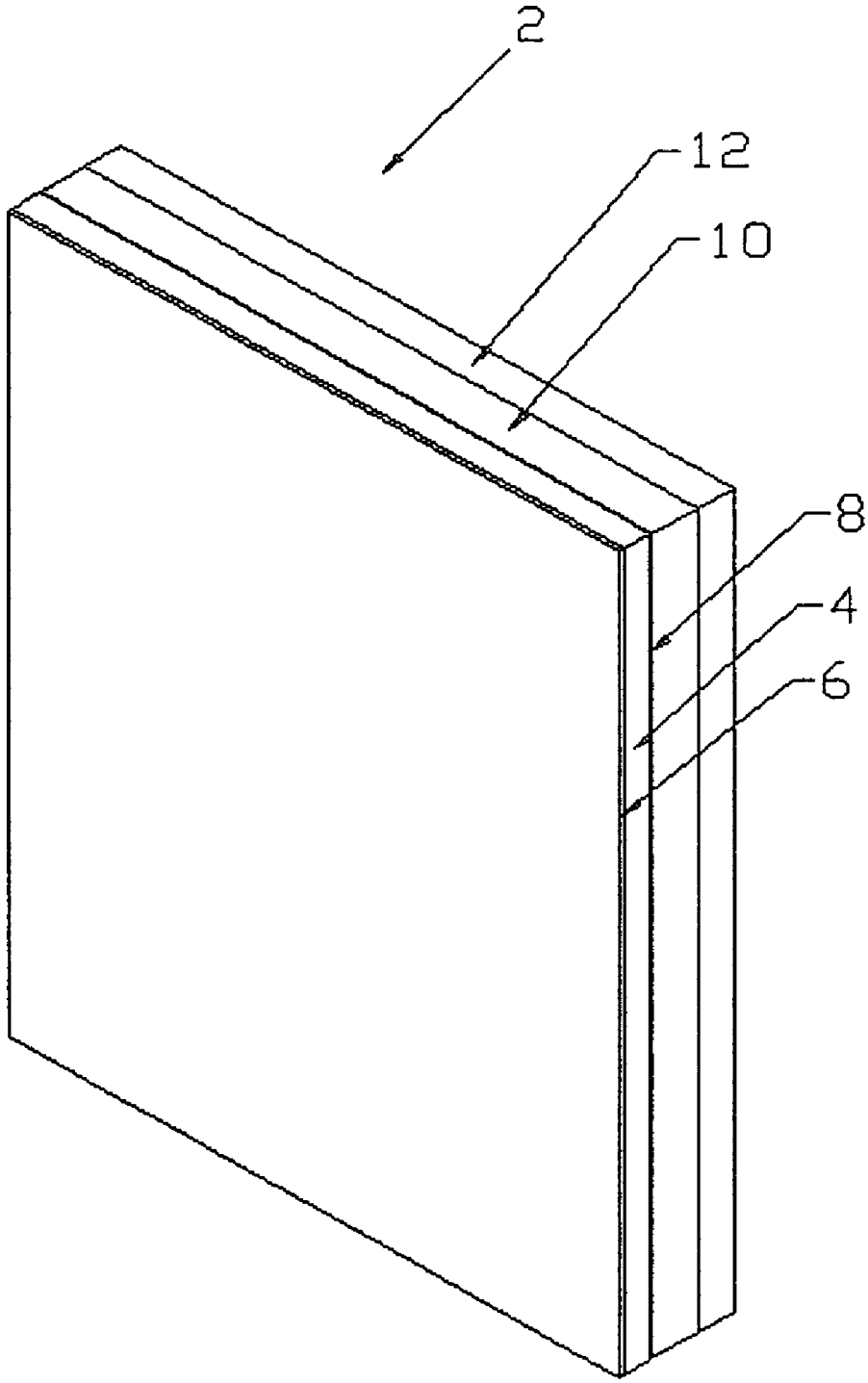
In FIG. 1, there is shown a perspective view of a flat armor having five layers.

In FIG. 1, an armor 2 has a ceramic layer 4 with a confinement layer 6 on a front thereof. The ceramic layer 4 is backed by a metallic layer 8, which in turn is backed by a composite layer 10. The composite layer is backed by an anti-trauma layer 12. The various layers are held together by a suitable adhesive.

The confinement layer is preferably a glass fiber reinforced layer. Preferably, the confinement layer 6 is held together with a urethane matrix. The metallic layer 8 is preferably made from titanium and, still more preferably, is a titanium alloy containing substantially 6% aluminum (for example, Titanium alloy ASTM B265, Grade 5, with nominal weight contents of 6% Aluminum, 4% Vanadium). The titanium layer is extremely thin relative to the ceramic layer 4. The composite layer 10 is formed of multiple layers, preferably multiple layers of Kevlar (a trade-mark). The ceramic layer is preferably boron carbide or silicon carbide. However, boron carbide is much more expensive than silicon carbide. Even though the boron carbide works better than the silicon carbide, in many applications of the armor, the silicon carbide will perform extremely well and boron carbide will not be required. The ceramic layer may be a mosaic (a series of smaller tiles shaped to fit together to cover a larger area without gaps) but is preferably a solid layer of ceramic. The anti-trauma layer is preferably a foam layer.

In FIG. 2, the armor 14 is identical to the armor of FIG. 1 such that the layers in FIG. 2 are curved. A curved armor is preferred by personnel as the curved armor fits much better on the chest of a user than a flat armor. Generally, the armor can be shaped as desired to best fit the shape of the body or object (not shown) that is being protected by the armor. The same reference numerals are used in FIG. 2 to describe those components that are identical (except for curvature) to the components of FIG. 1.

In FIG. 3, the relative thicknesses of the various layers shown in FIGS. 1 and 2 can be seen. The same reference numerals are used in FIG. 3 to describe those components that are identical to the components of FIGS. 1 and 2. It can be seen that the first metallic layer 8 is extremely thin relative to the ceramic layer 4. The first metallic layer 8 is preferably less than 10% of the thickness of the ceramic layer 4 for weight reduction purposes. It can also be seen that the confinement layer 6 is approximately twice as thick as the first metallic layer 8 and that the composite layer 10 is much thicker than the ceramic layer 4. Similarly, the anti-trauma layer 12 is much thicker than the ceramic layer 4, but it is not as thick as the composite layer 10. While the relative thicknesses of the various layers shown can vary substantially from that shown in FIG. 3, it has been found that the thicknesses shown work very well. In other words, the first metallic layer 8 could be much thicker, but the additional thickness will not contribute significantly to the protection provided to a user of the armor. Similarly, the ceramic layer would be made much thicker. However, adding thickness will make the armor much heavier and bulkier as well as much more expensive. Also, the confinement layer could be much thinner than that shown in FIG. 3, depending on the type of material used with little change in effectiveness.

Figure 4:
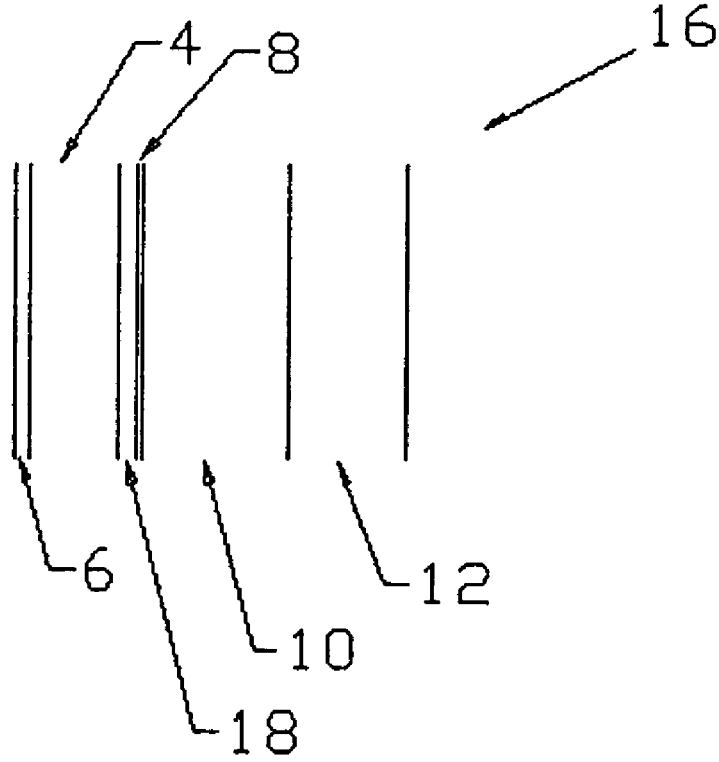
FIG. 4 is a schematic side view of an armor having six layers.

In FIG. 4, the same reference numerals are used to describe those components that are identical to the components of FIG. 3. An armor 16 shown in FIG. 4 is identical to the armor shown in FIG. 3 except that there is a second confinement layer located between the ceramic layer 4 and the first metallic layer 8. It has been found that the second confinement layer 18 does not contribute significantly to the protection provided by the armor 16, but it does improve the performance. The confinement layer 18 is preferably a fibre reinforced polymer layer that has an identical composition to the confinement layer 6. Preferably, the fibre reinforced polymer layer is a glass fibre reinforced polymer layer.

Figure 5:
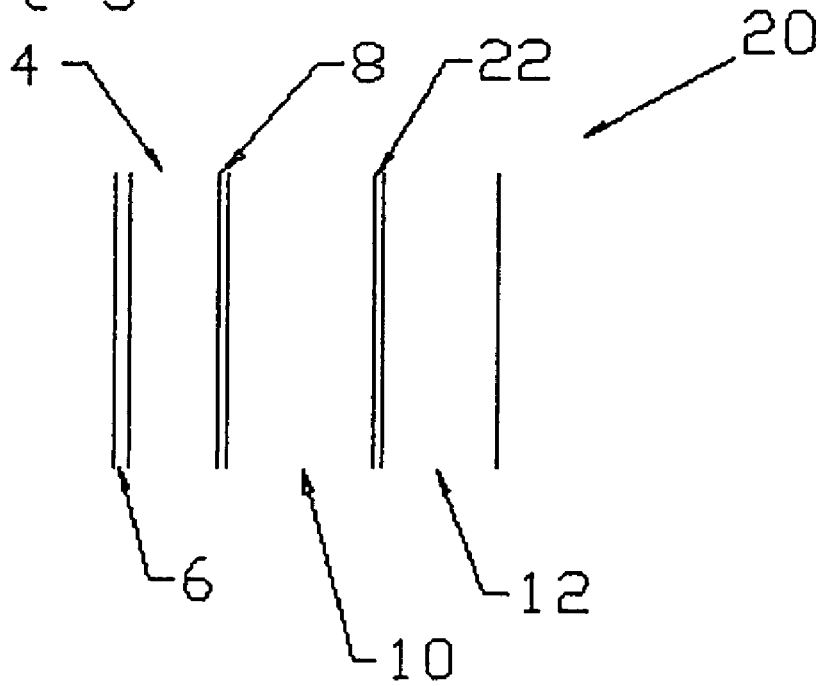
FIG. 5 is a schematic view of an armor having six layers with a second metallic layer located between the composite layer and the anti-trauma layer.

In FIG. 5, there is shown a further embodiment of the invention where an armor 20 has a second metallic layer 22 located between the composite layer 10 and the anti-trauma layer 12. The armor 20 does not have a second confinement layer located between the ceramic layer 4 and the first metallic layer, but an armor could be designed containing that feature. The same reference numerals are used in FIG. 5 to describe those components that are identical to the components of FIG. 3.

In some uses of the armor, it will be unnecessary to use the anti-trauma layer 12 so that the armor consists, from front to rear, of the confinement layer 6, the ceramic layer 4, the first metallic layer 8 and the composite layer 10 respectively. The armor is further described in the following examples.

EXAMPLE 1

A multi-component armor plate has a confinement layer, ceramic layer and first metallic layer that is 250 mm wide and 300 mm in height. The composite layer, a second metallic layer and anti-trauma layer has dimensions of 250 mm in width by 300 mm in height. The total mass is approximately 4.8 kg.

In example 1, the layers have the following thicknesses:

| Thickness | Material |
|---|---|
| 2 mm | Confinement (E-Glass with Urethane Adhesive) |
| 11.1 mm | Ceramic (Silicon Carbide Manufactured by Saint-Gobain |
| 1 mm | Ceramic Support (First Metallic Layer - Titanium) |
| 18.5 mm | 37 Layers of Kevlar (a trademark) 129 with PVB Phenolic Matrix |
| 1 mm | Composite Support (Second Metallic Layer - Titanium) |
| 15 mm | Anti-Trauma Layer |

All layers in the example are bonded using a urethane adhesive.

The design set out in example 1 was evaluated using NIJ (National Institute of Justice) Standard 0101.04 which incorporates impact of armor on a clay backing. A deformation level of 44 mm or less in clay is considered to result in survivable injuries to a human. The above design resulted in a deformation level of 44 mm when impacted by large caliber projectiles. The armor of example 1 was located within a vest (not shown) when the tests were conducted. The layer materials and thicknesses will vary in accordance with the specific requirements or circumstances of use.

The anti-trauma layer is preferably a polymeric foam layer. The purpose of the anti-trauma layer is to reduce blunt trauma and to increase separation between the armor and the torso of a user. The anti-trauma layer reduces impact loading, improves load distribution and energy absorption. Preferably, the anti-trauma layer is 128 kg/m$^3$ rigid polyurethane foam having a thickness of 15 mm. The foam layer is preferably FR-6708 (a trademark) sold by General Plastics Manufacturing Company.

Improved bonding and performance of the ceramic layer is achieved by ensuring a surface roughness of 1.26 (Ra), which is attained through sand blasting the ceramic tiles. The ballistic performance of the ceramic tile is improved significantly by the thin metallic backing. The metallic backing preferably has high strength and ductility. The use of the confinement layer and the metallic backing allows for a higher-density and lower-cost ceramic such as silicon carbide to be used in place of the more expensive boron carbide. (Currently boron carbide is approximately 2.5 times more expensive than silicon carbide). The composite backing is preferably comprised of various ballistic fabrics, fabric weaves and polymeric matrix materials to maximize the ballistic performance. The purpose of the composite backing is to stop the projectile and ceramic debris while minimizing deformation.

The armor of the present invention has withstood impacts by large caliber, armor piercing, high energy projectiles with low back face deformation. An example of projectiles is 0.5 caliber armor piercing projectiles.

The armor of example 1 had a maximum total areal density of 70 kg/m$^2$ at the thickest portion (eg. over the heart) of areal densities. While the armor of the present invention can be used in various applications, it is preferred to use the armor in a torso protection vest.

The armor 20 described in Example 1 has an overall maximum thickness of substantially 49 mm. It may be desirable to vary the thickness and/or material in a specific area or areas of the armour to achieve the desired results, which may be a lower overall weight.

To date, the use of metallic layers in personal body armor does not represent the conventional approach due to weight concerns. However, the current design disclosed herein utilizes a thin metallic layer to improve performance and reduce the weight of other components including the ceramic and composite backing so that no significant weight penalty is incurred. The metallic layer enhances performance through distribution of the impact load from the projectile and ceramic on the composite, confinement of the ceramic debris in the impact zone, and through impedance matching between the ceramic and metallic layer. The enhanced performance resulting from this metallic layer also allows for the use of lower ballistic performance ceramics in applications. The preferred material is titanium due to light weight and exceptional performance in these conditions. Other metallic materials could be considered including aluminum, requiring increased thickness, and high-strength steel, resulting in added weight.

By comparison, Canadian Patent application Serial No. 2,404,739 to Lucuta et al. discloses a multi-layer ceramic armor with improved ceramic components to deflect a projectile on impact, bonded to a shock absorbing layer constructed of a polymer-fiber composite material, and further bonded to a backing of ballistic composite or metallic material. This differs from the armor design disclosed herein in component stacking sequence and purpose. In particular, the first metallic layer in the current design is used to support the ceramic and enhance penetration resistance. The first and second metallic layers also act to minimize deformation of the composite material upon impact. In the designs disclosed in Lucuta et al. all ceramic materials are backed by: polymer-fiber composite, additional ceramic components, or polymeric components while the present design uses a metallic layer directly bonded to the ceramic. The backing layer in traditional armor is made of a ballistic composite material. Lucuta et al. claim the use of a ballistic composite or metallic layer. The current design uses a ballistic composite, which may be further supported by a thin metallic layer to enhance performance.

As used herein, the terms "comprises", "comprising", "including" and "includes" are to be construed as being inclusive and open ended, and not exclusive. Specifically, when used in this specification including claims, the terms "comprises" and "comprising" and variations thereof mean the specified features, steps or components are included. These terms are not to be interpreted to exclude the presence of other features, steps or components.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. A personal armor for protection against large caliber armor piercing projectiles comprising a ceramic layer with a first confinement layer on a front thereof, said ceramic layer being backed by a first nonporous solid metallic layer of high strength and ductility for distributing an impact load from a projectile and ceramic debris and for confining the debris in an impact zone within said ceramic layer, said first nonporous solid metallic layer being thinner than said ceramic layer, said first nonporous solid metallic layer being 1.11 mm or less in thickness and backed by a ballistic composite layer made of ballistic fabrics, fabric weaves and polymeric matrix materials for stopping a projectile and ceramic debris while minimizing deformation, with the various layers being bonded together by a suitable adhesive, said sequence of ceramic layer, nonporous solid metallic layer and ballistic composite layer exhibiting a back face deformation of 44 mm or less in clay as measured in accordance with a National Institute of Justice (NIJ) Standard when impacted on a front surface of said ceramic layer by projectile threats corresponding to NIJ Threat Levels up to 0.50 caliber, armor piercing, high energy projectiles.

2. An armor as claimed in claim 1 including an anti-trauma layer, said ballistic composite layer being backed by said anti-trauma layer for reducing blunt trauma and to increase separation between the armor and the torso of a user.

3. An armor as claimed in claim 1 including a second nonporous solid metallic layer, of high strength and ductility, said second nonporous solid metallic layer being thinner than said ceramic layer and said ballistic composite layer being backed by said second nonporous solid metallic layer.

4. An armor as claimed in claim 3 including an anti-trauma layer, said second nonporous solid metallic layer being backed by said anti-trauma layer for reducing blunt trauma and to increase separation between the armor and the torso of a user.

5. An armor as claimed in claim 1 wherein said ceramic layer, first confinement layer, first nonporous solid metallic plate, and said ballistic composite layer have a curvature such that the armor is fitted to a chest of a person wearing the armor.

6. An armor as claimed in claim 1 wherein said first nonporous solid metallic layer includes a titanium alloy.

7. An armor as claimed in claim 3 wherein said second nonporous solid metallic layer includes a titanium alloy.

8. An armor as claimed in claim 7 wherein said first nonporous solid metallic layer is a titanium alloy containing substantially 6% aluminum.

9. An armor as claimed in claim 8 wherein said second nonporous solid metallic layer is a titanium alloy containing substantially 6% aluminum.

10. An armor as claimed in claim 9 wherein said titanium alloy containing substantially 6% aluminum is Titanium alloy ASTM B265, Grade 5, with nominal weight contents of 6% Aluminum, 4% Vanadium.

11. An armor as claimed in claim 9 wherein said titanium alloy containing substantially 6% aluminum is Titanium alloy ASTM B265, Grade 5, with nominal weight contents of 6% Aluminum, 4% Vanadium.

12. An armor as claimed in claim 2 wherein said anti-trauma layer is made of a polymeric foam layer.

13. An armor as claimed in claim 4 wherein said anti-trauma layer is made of a polymeric foam layer.

14. An armor as claimed in claim 12 wherein said polymeric foam layer is about 128 $kg/m^3$ rigid polyurethane foam having a thickness of about 15 mm.

15. An armor as claimed in claim 13 wherein said polymeric foam layer is about 128 $kg/m^3$ rigid polyurethane foam having a thickness of about 15 mm.

16. An armor as claimed in claim 1 wherein said first confinement layer includes a glass fiber reinforced polymer layer.

17. An armor as claimed in claim 16 wherein said first confinement layer is bonded to the ceramic layer using a urethane matrix.

18. An armor as claimed in claim 1 wherein said composite layer is formed of multiple layers.

19. An armor as claimed in claim 18 wherein said multiple layers are multiple layers of aramid fibers within a polymeric matrix.

20. An armor as claimed in claim 1 wherein said ceramic layer is made of boron carbide or silicon carbide.

21. An armor as claimed in claim 1 wherein said ceramic layer is a solid layer of ceramic.

22. An armor as claimed in claim 1 wherein said ceramic layer is a mosaic.

23. An armor as claimed in claim 1 including a second confinement layer located between the ceramic layer and the first nonporous solid metallic layer.

24. An armor as claimed in claim 23 wherein said second confinement layer includes a glass fiber reinforced polymer layer.

25. An armor as claimed in claim 24 wherein said second confinement layer is bonded to the ceramic layer and the first nonporous solid metallic layer using a urethane matrix.

26. An armor as claimed in claim 1 wherein said first nonporous solid metallic layer is equal to, or less than, 10% of the thickness of the ceramic layer.

27. An armor as claimed in claim 1 wherein said confinement layer is approximately twice as thick as the first nonporous solid metallic layer, and wherein said composite layer is much thicker than said ceramic layer, and wherein said anti-trauma layer is much thicker than the ceramic layer and not as thick as the ballistic composite layer.

* * * * *

UNITED STATES PATENT AND TRADEMARK OFFICE

CERTIFICATE OF CORRECTION

PATENT NO. : 7,540,228 B1
APPLICATION NO. : 10/960284
DATED : June 2, 2009
INVENTOR(S) : Cronin et al.

It is certified that error appears in the above-identified patent and that said Letters Patent is hereby corrected as shown below:

Column 6, beginning at line 65, delete claim 8 and replace with:

8. An armor as claimed in claim 6 wherein said first nonporous solid metallic layer is a titanium alloy containing substantially 6% aluminum.

From Column 7, beginning at line 1, delete claims 9 and 10 and replace with:

9. An armor as claimed in claim 7 wherein said second nonporous solid metallic layer is a titanium alloy containing substantially 6% aluminum.

10. An armor as claimed in claim 8 wherein said titanium alloy containing substantially 6% aluminum is Titanium alloy ASTM B265, Grade 5, with nominal weight contents of 6% Aluminum, 4% Vanadium.

Signed and Sealed this

Twenty-ninth Day of June, 2010

David J. Kappos

David J. Kappos
*Director of the United States Patent and Trademark Office*